US005392472A

United States Patent [19]

Maxfield

[11] Patent Number: 5,392,472

[45] Date of Patent: Feb. 28, 1995

[54] POOL SKIMMER APPARATUS

[76] Inventor: Bernard R. Maxfield, 10 Eduardo Dr., Granite City, Ill. 62040

[21] Appl. No.: 127,333

[22] Filed: Sep. 27, 1993

[51] Int. Cl.[6] ..... E04H 4/16

[52] U.S. Cl. ..... 4/512; 4/490; 4/507; 4/541.6

[58] Field of Search ..... 4/541.3, 490, 507, 541.2, 4/541.1, 512, 509, 541.2, 541.3, 541.6, 492, 568, 491; 239/483, 461, 587.1, 479, 484, 489, 496, 513; 134/166 R, 169 R; 248/690, 691

[56] References Cited

U.S. PATENT DOCUMENTS

| | | | |
|---|---|---|---|
| 3,239,149 | 3/1966 | Lindberg, Jr. | 4/507 |
| 3,420,226 | 1/1969 | Berry, Sr. | 4/541.3 |
| 3,506,489 | 4/1970 | Baker | 134/10 |
| 4,060,215 | 11/1977 | Burns et al. | 248/690 |
| 4,340,039 | 7/1982 | Hibbard et al. | 4/541.6 |
| 4,393,526 | 7/1983 | Miller et al. | 4/490 |
| 4,438,537 | 3/1984 | Bickle | 4/492 |
| 4,475,691 | 10/1984 | Hintz | 239/587.5 |
| 4,520,514 | 6/1985 | Johnson | 4/490 |
| 4,581,781 | 4/1986 | Ebert | 4/541.3 |
| 4,599,753 | 7/1986 | Goodman | 4/541 |
| 4,717,078 | 1/1988 | Arp | 239/550 |
| 4,732,328 | 3/1988 | Schydlo | 239/538 |
| 4,734,189 | 3/1988 | Page, Jr. | 4/490 |
| 4,789,470 | 12/1988 | Wards | 4/490 |
| 4,818,389 | 4/1989 | Tobias et al. | 4/507 |
| 4,904,379 | 2/1990 | Ward | 4/490 |
| 5,059,314 | 10/1991 | Beckman | 4/490 |
| 5,172,432 | 12/1992 | Beland | 4/507 |

*Primary Examiner*—Henry J. Recla
*Assistant Examiner*—Gregory M. Vidovich
*Attorney, Agent, or Firm*—John R. Flanagan

[57] ABSTRACT

A pool skimmer apparatus used with a water filtration and recirculation system includes an outlet nozzle assembly and a scoop assembly. The outlet nozzle assembly is mounted to an inlet in the sidewall of a pool of water and operable for directing a flow of the water and debris floating on the surface of the water along an endless annular path extending substantially tangentially along the sidewall and the periphery of the pool of water. The scoop assembly is mounted to the outlet in the sidewall of the pool to project outwardly from the sidewall for intercepting and deflecting at least a portion of the water and debris carried by the water from the endless annular path of flow and into the outlet of the pool to thereby assist in skimming off portions of the debris floating on the surface of the pool of water.

10 Claims, 2 Drawing Sheets

POOL SKIMMER APPARATUS

BACKGROUND OF THE INVENTION

1. Field of the Invention

The present invention generally relates to an apparatus for cleaning a swimming pool and, more particularly, is concerned with a pool skimmer apparatus for cleaning floating debris from a swimming pool.

2. Description of the Prior Art

Swimming pool filtration systems have long been used to remove floating or suspended debris from swimming pools. Various means have been employed to agitate swimming pool water or set up currents to direct swimming pool water towards skimmers which then remove floating debris. Debris is relatively more easily removed by filtration systems as it floats on the surface of the swimming pool water. Once the debris has become water logged and sunk to the bottom of the pool, it then must usually be removed by a separate manual cleaning operation.

Different systems have been proposed in the prior art for cleaning debris from pools. One such debris cleaning system being representative of such prior art systems is disclosed in U.S. Pat. No. 4,393,526 to Miller et al. The Miller et al patent discloses an apparatus having a plurality of water jets carried by hoses that snake and undulate across the bottom of the pool in combination with water jets positioned on the surface that induce a current toward skimmers provided in the pool. While Miller discloses an effective means for dislodging settled debree for the bottom of a pool, it does not disclose a highly effective means of directing a surface current and entrained floating debris toward a skimmer.

Consequently, a need exists for a swimming pool cleaning apparatus that can efficiently and effectively direct floating debris toward a skimmer for filtration and removal.

SUMMARY OF THE INVENTION

The present invention provides a pool skimmer apparatus which satisfies the aforementioned need by providing a simple, effective means for directing floating debris toward a collection location at the periphery of the swimming pool and then diverting and collecting the debris at such location. The pool skimmer apparatus of the present invention is employed in conjunction with a water filtration and recirculation system which includes a water pump and one or more conduits connected together and providing flow communication of water between an inlet and an outlet in a sidewall of a swimming pool.

The pool skimmer apparatus of the present invention comprises: (a) an outlet nozzle assembly operable for directing a flow of the water and debris floating on the surface of the water along an endless annular path extending substantially tangentially along the sidewall and the periphery of the pool of water; and (b) a scoop assembly projecting outwardly from the sidewall of the pool for intercepting at least a portion of the endless annular path of flow of the water to thereby assist in skimming off portions of floating debris entrained on the surface of the pool of water moving near to the outlet of the pool.

More particularly, the outlet nozzle assembly includes an annular base portion mounted to the inlet on the sidewall of the swimming pool and a swivel head portion rotatably mounted to the annular base portion and defining an outlet nozzle adapted to eject a jet of water in a tangential relation to the base and thereby to the sidewall and periphery of the pool so as to cause the water on the surface of the pool of water to flow along the endless annular path about the sidewall and periphery of the pool.

The scoop assembly includes a debris collection housing mounted to the outlet on the sidewall of the swimming pool and a scoop device having an arcuate blade-like deflector portion and a mounting portion connected to the deflector portion and adapted to be attached to the debris collection housing.

The endless annular path of water flow about the sidewall and the periphery of the pool generated by the outlet nozzle assembly creates centrifugal forces which acts on debris floating on the surface of the pool causing such debris to migrate toward the sidewall and periphery of the pool where the scoop device can intercept the path of some of the floating debris and thus deflect the floating debris into the debris collection housing along with the portions of the water that is being drawn in the filtration and recirculation system by the pump.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
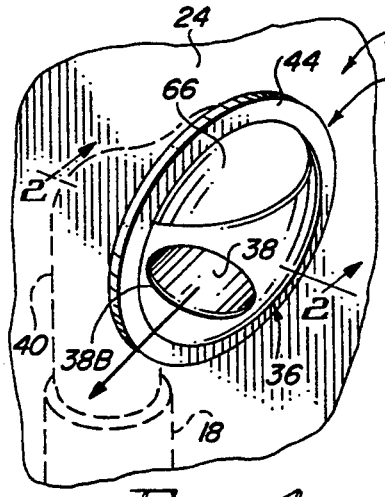
FIG. 1 is a perspective view of an outlet nozzle assembly of the pool skimmer apparatus of the present invention.
Figure 2:
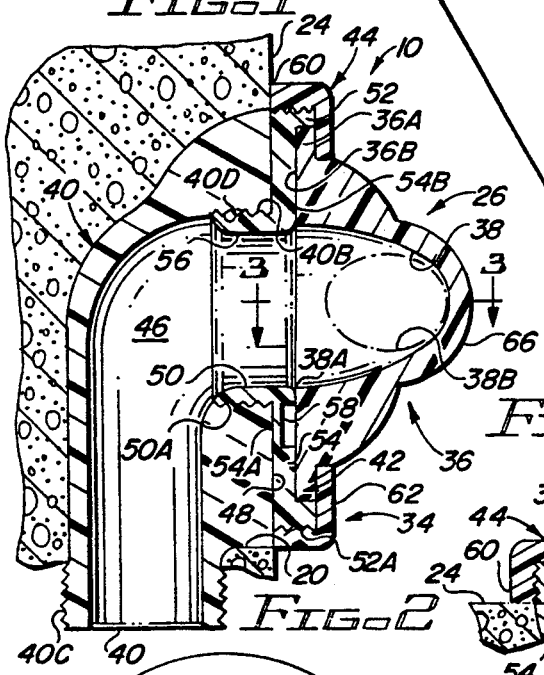
FIG. 2 is a vertical sectional view of the outlet nozzle assembly of the apparatus taken along line 2—2 of FIG. 1.
Figure 6:
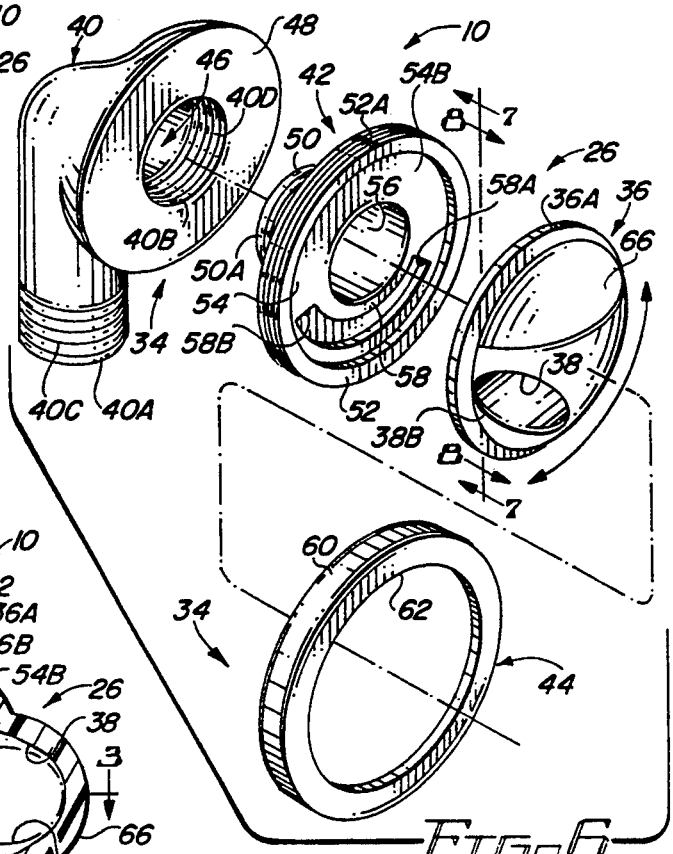
FIG. 6 is an exploded perspective view of the pool skimmer apparatus of the present invention.
Figure 3:
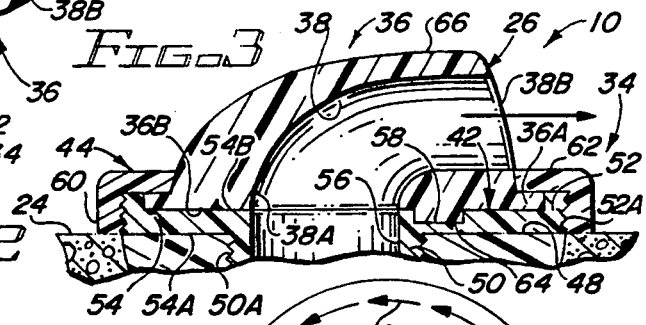
FIG. 3 is a horizontal sectional view of the outlet nozzle assembly of the apparatus taken along line 3—3 of FIG. 2.
Figure 5:
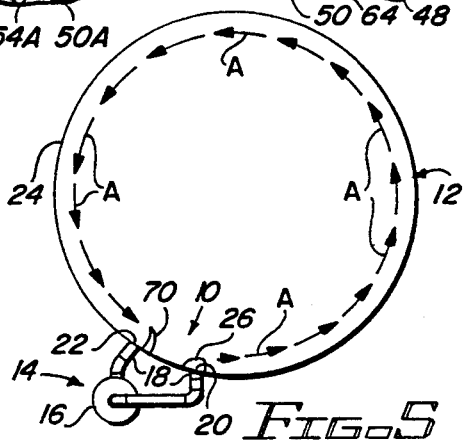
FIG. 5 is a top schematic view of the pool skimmer apparatus of the present invention.
Figure 9:
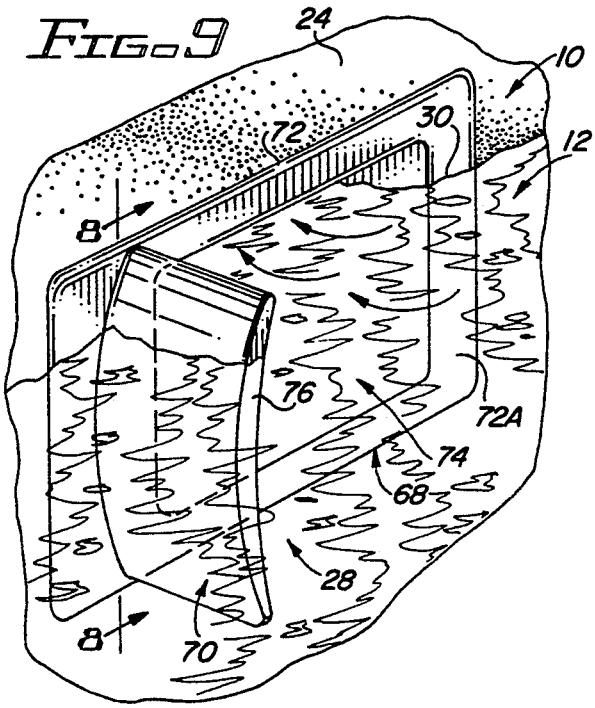
FIG. 9 is a perspective view of a scoop assembly of the pool skimmer apparatus of the present invention.

Referring to the drawings, and particularly to FIGS. 1, 5 and 9, there is illustrated a swimming pool skimmer apparatus, generally designated 10, of the present invention for skimming floating debris from a swimming pool 12 of water. The pool skimmer apparatus 10 is shown in its normal operation in FIG. 5. The pool skimmer apparatus 10 is employed in conjunction with a water filtration and recirculation system 14 which includes a water pump 16 and a series of conduits 18 connected together and providing flow communication between an inlet 20 and an outlet 22 in a sidewall 24 of the pool 12.

Figure 4:
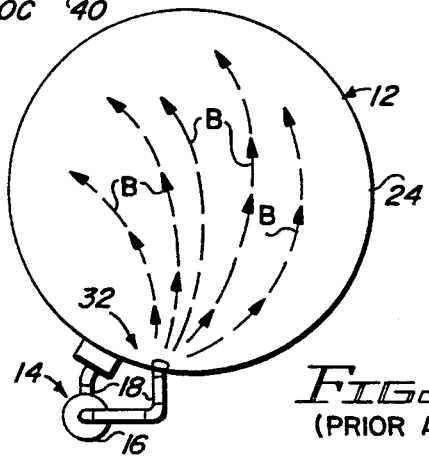
FIG. 4 (PRIOR ART)
FIG. 4 is a top schematic view of a prior art pool cleaning apparatus.

Basically, the pool skimmer apparatus 10 includes a an outlet nozzle assembly 26 mounted to the inlet 20 in the sidewall 24 of the pool 12 and a scoop assembly 28 mounted to the outlet 22 in the sidewall 24 of the pool 12. The outlet nozzle assembly 26 is operable for directing a flow of the water and any debris floating on the surface 30 of the pool 12 of water along an endless annular path, as represented by the circular path of arrows A in FIG. 5, extending substantially tangentially along the sidewall 24 and about the periphery of the pool 12 of water. The scoop assembly 28 projects outwardly from the sidewall 24 of the pool 12 for intercepting and diverting at least a portion of the water and debris moving in the endless annular flow path so as to thereby assist in skimming off portions of floating debris entrained on the surface 30 of the pool of water as it moves near to the outlet 22 of the pool. In contrast thereto, as shown in FIG. 4, in a typical prior art pool cleaning system 32, as represented by the arrows B the water is merely injected into the pool by the water filtration and recirculation system 14 without regard to creating an endless annular flow of water along the sidewall 24 and about the periphery of the pool 12, as is the case with the pool skimmer apparatus 10 of the present invention.

Referring to FIGS. 2, 3 and 6–8, the outlet nozzle assembly 26 includes an annular base portion 34 and a swivel head portion 36. The annular base portion 34 is mounted to the inlet 20 on the sidewall 24 of the swimming pool 12. The swivel head portion 36 is rotatably mounted to the annular base portion 34 and defines an outlet nozzle passageway 38 adapted to eject a jet of water in a tangential relation to the annular base portion 34 and thereby to the sidewall 24 and the periphery of the pool 12 so as to cause the water on the surface 30 of the pool 12 of water to flow along the endless annular path about the sidewall 24 and the periphery of the pool 12.

More particularly, the annular base portion 34 of the outlet nozzle assembly 26 includes an elbow fitting 40, an annular base collar 42, and an annular retaining ring 44. The elbow fitting 40 of the annular base portion 34 defines an elongated passageway 46 defined therethrough and has an inlet end 40A and an outlet end 40B located at the opposite ends of the passageway 46 and angularly displaced about 90° from one another. The inlet end 40A of the elbow fitting 40 has an externally-threaded section 40C defined thereon connected to one of the conduits 18. The outlet end 40B of the elbow fitting 40 is enlarged so as to define a substantially flat annular surface 48 around the outlet end 40B of the passageway 40. Also, the outlet end 40B of the elbow fitting 40 has an internally-threaded section 40D defined thereon.

The annular base collar 42 of the annular base portion 34 includes a pair of inner and outer annular rims 50, 52 and an annular flange 54 extending between and interconnecting the inner and outer annular rims 50, 52. Each of the inner and outer annular rims 50, 52 has externally-threaded sections 50A, 52A defined thereon. The inner annular rim 50 defines a central opening 56 through the base collar 42 and at its externally-threaded section 50A is threadably coupled to the internally-threaded section 40D on the outlet end 40B of the elbow fitting 40. The annular flange 54 of the base collar 42 extends radially around the inner annular rim 50 and defines a pair of opposite inner and outer flat surfaces 54A, 54B. The inner flat surface 54A on the annular flange 54 abuts the flat annular surface 48 on the outlet end 40B of the elbow fitting 40. The outer flat surface 54B on the annular flange 54 has a key slot 58 defined therein having an arcuate configuration.

The annular retaining ring 44 of the annular base portion 34 has an outer annular lip 60 and an inner annular ring 62. The outer annular lip 60 has an internally-threaded section 60A for threadably coupling to the externally-threaded section 52A on the outer annular rim 52 of the base collar 42. When the annular retaining ring 44 is threaded on the outer annular rim 52 of the base collar 42, the inner annular ring 62 seats against the outer annular rim 52 in spaced relation from the outer flat surface 54B on the annular flange 54 of the base collar 42 so as to rotatably mount an annular peripheral edge 36A of the swivel head portion 36 therebetween.

The swivel head portion 36 of the outlet nozzle assembly 26, in addition to the annular peripheral edge 36A, has an inner face 36B abutting the outer surface 54B of the annular flange 54 of the base collar 42 of the annular base portion 34 and a key 64 attached to and projecting from the inner face 36B and protruding into the arcuate key slot 58 defined in the outer surface 54B. The key slot 58 has a pair of opposite ends 58A, 58B in the form of shoulders which define opposite limits of the rotational movement of the swivel head portion 36 relative to the annular base portion 34.

The swivel head portion 36 also has a nozzle body 66 projecting from the inner face 36B and defining the outlet nozzle passageway 38 therethrough. The outlet nozzle passageway 38 has an inlet end 38A which maintains communication with the central opening 56 through the base collar 42 and the passageway 46 through the fitting 40 of the annular base portion 34 even as the swivel head portion 36 is rotated relative thereto. The nozzle passageway 38 has an arcuate configuration such that an outlet end 38B of the nozzle passageway is disposed in a substantially transverse relation to an inlet end 38A thereof, for instance about 90° and is spaced laterally outwardly in an offset relation from the inlet end 38A and thereby adapts the swivel head portion 36 to guide the jet of water through an arcuate path and to eject the jet of water in the tangential relation to the annular base portion 34 and thereby to the sidewall 24 and periphery of the pool 12 so as to cause the water on the surface of the pool of water to flow along the endless annular path about the sidewall 24 and periphery of the pool 12. The rotational mounting of the swivel head portion 36 permits, during periods of non-use of the pool skimmer apparatus 10, the swivel head portion 36 to be rotated from the lateral tangential position shown in FIGS. 2 and 3 to a downward position where the jet of water is injected downward toward the bottom of the pool 12.

Figure 10:
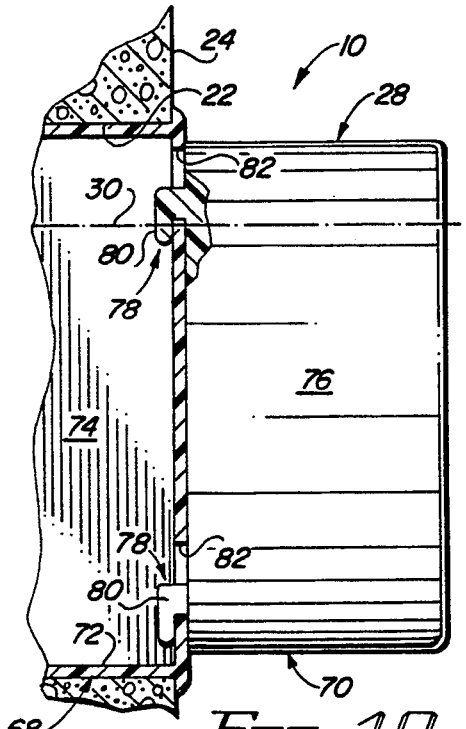
FIG. 10 is a vertical sectional view of the scoop assembly taken along line 10—10 of FIG. 9.
Figure 7:
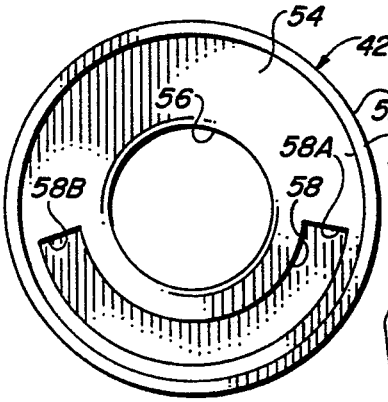
FIG. 7 is an end view of an annular base portion of the outlet nozzle assembly as seen along line 7—7 of FIG. 6.
Figure 8:
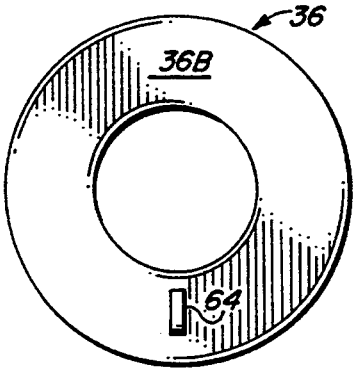
FIG. 8 is an end view of a swivel head portion of the outlet nozzle assembly as seen along line 8—8 of FIG. 6.
Figure 11:
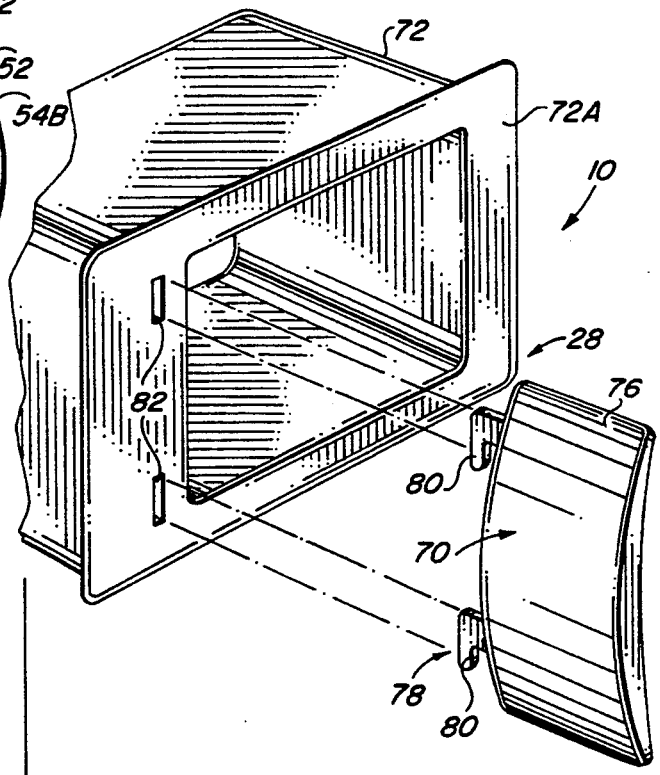
FIG. 11 is an exploded perspective view of a scoop device and debris collection housing of the scoop assembly of the apparatus.

Referring to FIGS. 9–11, the scoop assembly 28 of the pool skimmer apparatus 10 includes a debris collection basket or housing 68 and a scoop device 70. The debris collection housing 68 of the scoop assembly 28 is mounted to the outlet 22 in the sidewall 24 of the swimming pool 12. The debris collection housing 68 has a box-shaped annular frame 72 defining a cavity 74 extending therethrough.

The scoop device 70 of the scoop assembly 28 is attached to and extends from the collection housing 68 and into the endless annular path of flow. More particularly, the sweep device 70 includes an arcuate blade-like deflector portion 76 and a mounting portion 78 connected to the deflector portion 76 and adapted to be attached to the debris collection housing 68. The mounting portion 78 of the scoop device 70 includes a plurality of hook-shaped tabs 80 and the annular frame 72 has a front face 72A with a plurality of slots 82 defined therein for removably receiving the hook-shaped tabs 80. The scoop device 70 can be removed from the housing 68 during periods of non-use of the pool skimmer apparatus 10.

The endless annular path of water flow about the sidewall 24 and the periphery of the pool 12 generated by the outlet nozzle assembly 26 of the pool skimmer apparatus 10 creates centrifugal forces which acts on debris floating on the surface 30 of the pool 12 of water, causing such debris to migrate toward the sidewall 24 and periphery of the pool 12 where the scoop device 70 of the scoop assembly 28 can intercept the path of some of the floating debris and thus deflect the floating debris into the debris collection housing 68 along with the portions of the water that is being drawn in the filtration and recirculation system 14 by the pump 16. Conversely, heavier sinking debris will tend to migrate toward the center of the pool and sink to a resting place on the pool floor near the center of the pool.

It is thought that the present invention and its advantages will be understood from the foregoing description and it will be apparent that various changes may be made thereto without departing from the spirit and scope of the invention or sacrificing all of its material advantages, the form herein before described being merely a preferred or exemplary embodiment thereof.

I claim:

1. A pool skimmer apparatus for use with a water filtration and recirculation system being disposed between and interconnecting in flow communication an inlet and an outlet in a sidewall of a swimming pool of water, said pool skimmer apparatus comprising:

(a) an outlet nozzle assembly mountable to the inlet in the sidewall of the pool and being operable for directing a flow of the water and debris floating on the surface of the water along an endless peripheral path extending substantially adjacent along the sidewall of the pool of water; and (b) a scoop assembly mountable to the outlet in the sidewall of the pool to project outwardly from the sidewall for intercepting and deflecting at least a portion of the water and debris carried by the water from the endless annular path of flow and into the outlet of the pool to thereby assist in skimming off portions of the debris floating on the surface of the pool of water;

(c) said outlet nozzle assembly including an annular base portion defining an axial flow passage in a direction normal to said sidewall and mountable to the inlet in the sidewall of the swimming pool, and a swivel head portion rotatably mounted to said annular base portion and defining an outlet nozzle passageway adapted to eject a jet of water in a substantially perpendicular relation to said axial flow passage of said annular base portion and thereby parallel to the sidewall of the pool so as to cause the water on the surface of the pool of water to flow along the endless peripheral path;

(d) said outlet nozzle assembly further including a fitting adapted to be mounted to the inlet in the pool sidewall, said fitting having a passageway defined therethrough and an inlet end and outlet end at opposite ends of the passageway, said fitting also having a substantially flat annular surface defined around said outlet end of said passageway, said outlet end of said passageway having an internally-threaded section thereon;

(e) said annular base portion having a pair of inner and outer annular rims each having externally-threaded sections thereon and an annular flange extending between and interconnecting said inner and outer annular rims, said axial flow passage extending through said inner annular rim and said annular flange, said inner annular rim threadably coupled to said outlet of said fitting and said swivel head portion rotatably mounted on said annular flange.

2. The apparatus of claim 1 wherein said annular flange extends radially around said inner annular rim defining a pair of opposite first and second substantially flat surfaces, said first surface abutting said flat annular surface of said fitting.

3. The apparatus of claim 2 wherein said second surface on said annular flange includes a key slot defined therein having an arcuate configuration.

4. The apparatus of claim 3 wherein said annular base portion also includes an annular retaining ring adapted to be connected thereto having an internally-threaded section for threadably coupling to said externally-threaded section on said outer annular rim so as to rotatably mount said swivel head portion at a peripheral edge thereof between said retaining rim and said second surface on said annular flange.

5. The apparatus of claim 4 wherein swivel head portion has an inner face abutting said second surface of said annular flange of said base collar and a key attached to and projecting from said inner face and protruding into said key slot defined in said second surface, said key slot having opposite ends which define opposite limits of the rotational movement of said swivel head portion relative to said annular base portion.

6. The apparatus of claim 5 wherein said swivel head portion has a nozzle body projecting from said face plate and defining said nozzle passageway therethrough which communicates with said axial flow passage, said nozzle passageway has an arcuate configuration such that an outlet of said nozzle passageway is disposed in a substantially transverse relation to an inlet thereof which communicates with said axial flow passage.

7. The apparatus of claim 1 wherein said scoop assembly includes:

a debris collection housing mountable to the outlet in the sidewall of the swimming pool; and a scoop device attached to and extending from said collection housing and into the endless peripheral path of flow.

8. The apparatus of claim 7 wherein said debris collection housing has an annular frame defining a cavity extending therethrough.

9. The apparatus of claim 8 wherein said scoop device has an arcuate blade-like deflector portion and a mounting portion connected to the deflector portion and adapted to be attached to the debris collection housing.

10. The apparatus of claim 9 wherein said mounting portion of said scoop device includes a plurality of hook-shaped tabs and said annular frame has a plurality of slots therein for receiving said hook-shaped tabs.

* * * * *